United States Patent [19]

Nall et al.

[11] Patent Number: 4,603,626

[45] Date of Patent: Aug. 5, 1986

[54] TRASH COMPACTOR

[76] Inventors: Kenneth L. Nall, 3 Quail Hill Dr.; Floyd B. Littleton, Jr., 102 Boulder Rd., both of Greenville, S.C. 29607

[21] Appl. No.: 669,678

[22] Filed: Nov. 9, 1984

[51] Int. Cl.[4] ..... B30B 15/30

[52] U.S. Cl. ..... 100/215; 100/229 A; 100/295

[58] Field of Search ..... 100/229 A, 295, 215; 312/290, 303, 323, 333

[56] References Cited

U.S. PATENT DOCUMENTS

| | | | |
|---|---|---|---|
| 1,234,900 | 7/1917 | Hipschen | 312/290 |
| 3,071,805 | 1/1963 | Merkle | 100/295 X |
| 3,367,019 | 2/1968 | Williamson | 100/295 X |
| 3,490,631 | 1/1970 | Smith | 100/229 A X |
| 3,585,925 | 6/1971 | Fox | 100/229 A X |
| 3,610,139 | 10/1971 | Bowles | 100/229 A X |
| 3,625,140 | 12/1971 | Glanz | 100/229 A X |
| 3,687,064 | 8/1972 | Glanz | 100/229 A X |
| 4,235,165 | 11/1980 | Fenner | 100/229 A X |
| 4,393,767 | 7/1983 | Dutfield | 100/229 A X |
| 4,424,740 | 1/1984 | Gwathney | 100/229 A X |

*Primary Examiner*—Billy J. Wilhite
*Attorney, Agent, or Firm*—Dority & Manning

[57] ABSTRACT

A trash compactor is provided with a ram having a single inclined surface so that on the ram's downward compacting stroke a horizontal force is created through the trash acting on the bin wall to press the bin against a retaining bar thereby preventing "walking" or horizontal movement of the bin.

12 Claims, 3 Drawing Figures

TRASH COMPACTOR

FIELD OF THE INVENTION

This invention relates generally to vertical trash compactors and particularly to vertical trash compactors for industrial or commercial uses wherein the trash bin or container is removed and dumped by a truck having a forklift apparatus.

BACKGROUND OF THE INVENTION

Large, industrial size trash containers are typically encountered around parking lots in apartment areas, shopping centers, motels, restaurants, and stores. These containers are usually open and as they become filled, trash spills out causing an unsightly appearance. These containers present not only safety hazards but sanitary hazards as well. To compound the problem even further, when a filled container is picked up by a forklift truck and dumped the uncompacted trash tends to be spilled and scattered about the area.

Accordingly, one object of the present invention is to provide a trash compactor which is closed and which provides a compacted mass to be dumped thereby reducing the likelihood of spillage, in addition to increasing the volume of loose trash it will contain.

In prior art compactors complex compacting mechanisms are often found utilizing multi-action ram movements and pivoting actions leading to eventual maintenance problems and less compaction. As an example of such a compactor, reference is made to U.S. Pat. No. 4,235,165 issued on Nov. 25, 1980 to Gordon H. Fenner et al.

Another object of the present invention is to provide a compactor which has a minimum of moving parts and operates on simple reciprocal vertical motion.

In some vertical compactors, the problem of "walking" is encountered where the force of the trash against the side walls as it is being compacted tends to make the container or bin move horizontally. In U.S. Pat. No. 4,393,767 issued July 19, 1983 to James H. Dutfield, a sloped floor in the frame which holds the compactor is provided so that the container itself is at an angle while the trash is compacted. However, the ram is shaped so that it will provide horizontal force in at least two directions so that there might still be a tendency for the container to move horizontally.

A still further object of the present invention is to provide a trash compactor with a ram which will impart horizontal force in only one direction which can be readily restrained.

Other prior art patents of interest related to compactors are U.S. Pat. No. 1,234,900 issued on July 31, 1917 J. H. Hipschen; U.S. Pat. No. 3,585,925 issued on July 22, 1971 to Harold K. Fox; U.S. Pat. No. 3,625,140 issued on Dec. 7, 1971 to Richard G. Glanz; U.S. Pat. No. 3,687,064 issued on Aug. 29, 1972 to Richard G. Glanz; U.S. Pat. No. 3,490,631 which issued on Jan. 20, 1970 to H. E. Smith; and U.S. Pat. No. 3,610,139 which issued on Mar. 13, 1969 to Samuel V. Bowles.

The objects stated above and many other advantages are achieved by the trash compactor of this invention which is described in the summary of the invention set forth below.

SUMMARY OF THE INVENTION

In one aspect, the present invention is a trash compactor comprising a bin for receiving trash having an open top and closed side walls and bottom; a fixed support frame adapted for removably receiving the bin and for restraining a side wall of the bin when trash is compacted therein; compacting means located on the frame above the open top of the bin when the bin is placed within the frame, the compacting means comprising actuating means and a ram driven in vertical reciprocal motion by said actuating means, said ram having an inclined surface for compacting trash when driven into said bin, said surface being positioned to impart a horizontal component of force through the compacted trash against the bin wall which is restrained by said frame whereby the bin does not move horizontally during a trash compacting cycle.

The invention will be better understood by reference to the drawings which are described below.

DESCRIPTION OF A PREFERRED EMBODIMENT

Figure 1:
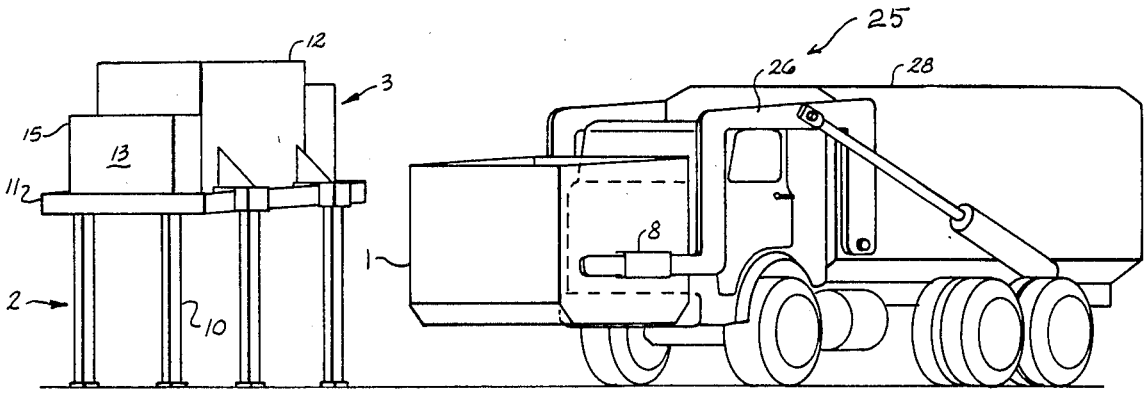
FIG. 1 is a perspective view of a truck with a forklift apparatus removing a bin from the fixed frame of the present invention.

Looking first at FIG. 1, the removable bin 1 of the present invention is shown as being in position for either being dumped into truck 25 by forklift 26 or in position for being received by the support frame 2. In the position shown, the bin will either be empty or filled with compacted trash. The frame which is either about to receive the bin 1 or from which bin 1 has been removed further comprises supporting legs or posts 10 which carry a generally rectangular frame member which includes a horizontal retaining bar 11. The rectangular frame portion carries housing 12 which has chute or hopper 15 and door 13.

Figure 2:
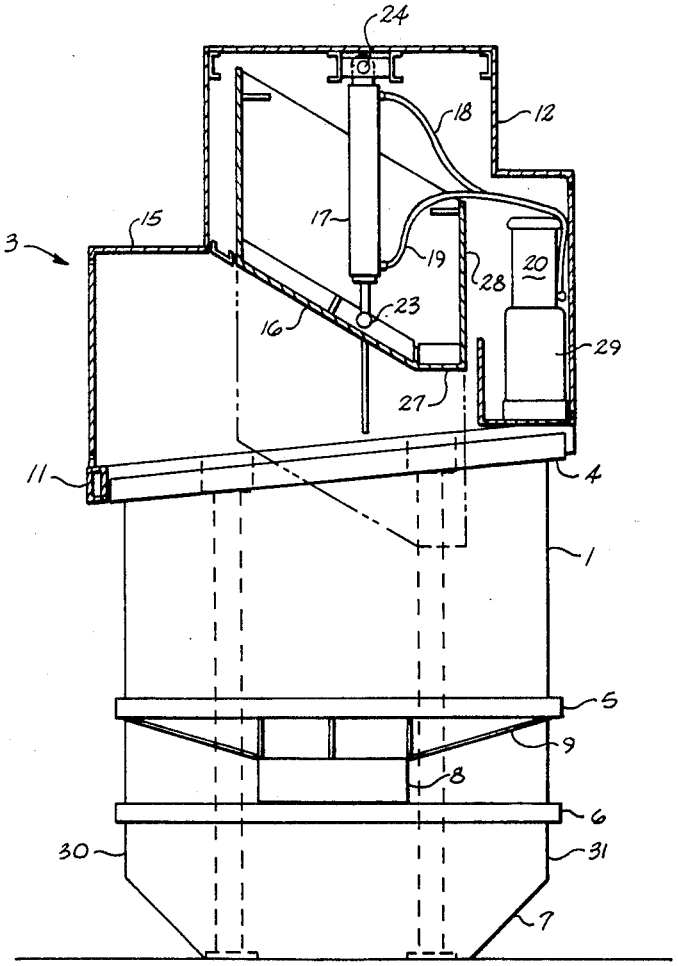
FIG. 2 is a side elevational view in partial section showing the ram and actuating means of the present invention.

Referring now to FIG. 2, ram unit 3 is shown positioned above bin 1. The ram unit 3 comprises housing 12 and located on the interior top wall of the housing 12 is the actuating support means 24 which comprises a mounting pin 23 and frame member into which the mounting pin is journaled. A hydraulic cylinder 17 which comprises the actuating means has a piston therein and a connecting rod which terminates with pin 23 which is journaled into a support frame member of ram 16. In this position, the inclined surface of ram 16 is clearly shown and this inclined surface slopes upwardly from the horizontal surface 27. High vertical walls 28 are provided on the ram so that trash does not spill over on top of the ram thus avoiding a maintenance and sanitary hazard which is present in some prior art designs.

Hydraulic lines 18 and 19 extend from pump 20 to carry the actuating working fluid to the cylinder 17. Pump 20 is driven by electric motor 29. By way of illustration, the pneumatic cylinder will be four inches in diameter with a two inch diameter piston and a twenty-eight inch stroke.

In FIG. 2, the ram is at the top of its vertical stroke and the dotted lines represent the ram at the bottom of its stroke. One feature of the present invention is that it is unnecessary to operate the ram and send it through the cycle each time trash is placed into the bin. There is no need to begin compaction until trash is approaching the top of the bin. An advantage of the inclined surface 16 of the ram as shown is that the inclined surface faces the door 13 and acts as a guide chute for the trash going into the bin 1.

A reinforcing rim 4 is carried adjacent the top of the bin 1 with additional reinforcing bracing bands 5 and 6 carried above and below the forklift receiving means 8 on the side of the bin. The forklift receiving means 8 includes guide or camming surface 9 to guide the forklift finger into the slot which comprises the receiving means 8 for lifting and moving bin 1. As can be seen in FIG. 2, the bottom of bin 1 is flat and preferably rest on a concrete pad which is positioned between the legs 10. The lower portion of the front or leading wall 30 and rear or trailing wall 31 of bin 1 is inclined inwardly as shown for two purposes. One purpose is to make it easier to insert the bin inside the frame as the inclined lower portion of the leading wall 30 will act as a camming or guiding surface. The other purpose for the sloped or inclined walls is to eliminate right angle corners so that the compacted trash may be more readily removed from the bin because trash is not wedged into a sharp corner.

Figure 3:
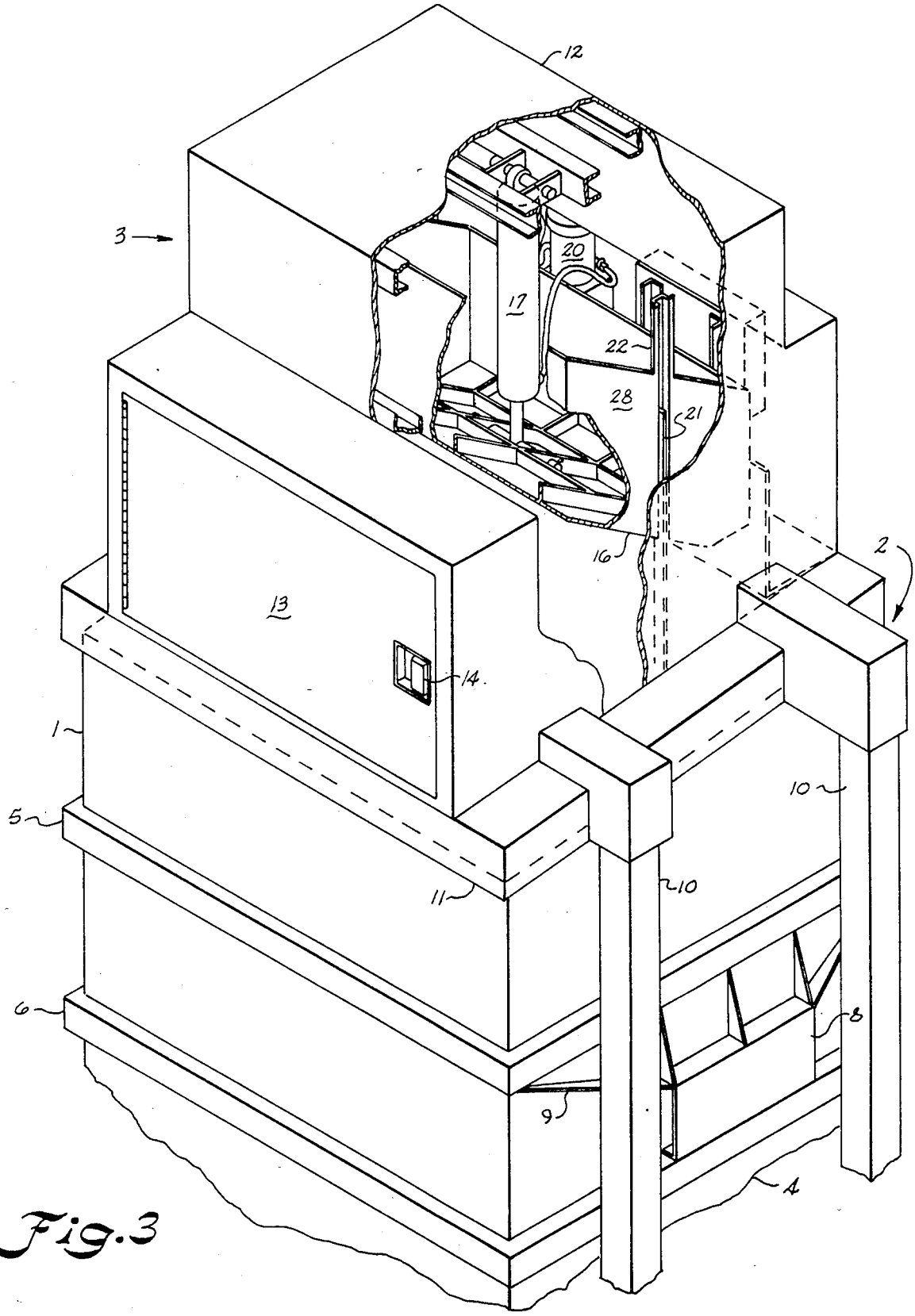
FIG. 3 is a perspective view of the trash compactor of the present invention having a cut-away view of the housing to show the arrangement of the ram and actuating means.

FIG. 3 is a perspective showing the door 13 with latch and handle 14 which controls the opening and shutting of the door to chute 15. For safety and security purposes a key lock (not shown) is provided in the door. In the cut-away view of the housing 12 of ram unit 3, the ram 16 is shown with its walls 28 and interior supporting frame to which the connecting rod of the hydraulic piston and cylinder 17 is connected. To ensure that the ram 16 travels in a true vertical path and does not get wedged by the force of uneven trash compaction, guide slot 22 in the ram wall is provided and ram guide 21 which is fixedly attached to the housing 12 ensures that the ram 16 keeps its proper orientation in its vertical strokes.

Not shown but provided adjacent the door latch on the housing will be key operated switch so that the actuating means will not cycle without the key being turned on. In addition, there is a safety switch associated with the door 13 so that the compactor will not operate without the door being securely closed and the actuating means will shut down during a cycle if the door is opened. Other features are that a container location switch is provided so that the compactor will not turn on if the bin 1 is not properly located beneath the ram. Furthermore, a driver warning light is provided which light burns on when the compactor is operating or when the ram is not in its top position or a neutral position. In some models the ram is held in a neutral position adjacent the top of the bin for preventing trash from falling from the bin when the bin is removed from the frame. This prevents the driver from removing the bin and damaging the ram should the cylinder lose pressure and the rod drift downwardly. The safety switches and light can be wired into the circuit in any suitable conventional manner.

Referring to all three figures now, in operation door 13 is unlocked and opened by latch 14 and trash is placed therein and guided into the bin 1 by the inclined surface of the ram 16. When the trash within the bin has reached a level within the stroke of the ram, the door 13 is shut and the power is turned on by a key and electric motor 29 is turned on to pump 20 which provides fluid under pressure to cylinder 17 to force ram 16 downwardly to compact the trash. Typically, the ram will penetrate from about eight to twenty-one inches into the bin. As the ram descends towards the bottom of the stroke and contacts the trash and begins to compact same, not only is a downward force imparted against the trash, a horizontal force is imparted towards the horizontal retaining bar 11 which is integral with the frame member. In other words, the frame member 11 is sloped as shown in FIG. 2 and the rear portion of the frame member is the retaining bar 11. The force of the trash spreading outwardly is directed against a rear wall or leading wall 30 of the bin and this force is transmitted through the reinforced rim 4 which contacts the retaining bar 11. In this position, the bin is completely secured from movement as a result of the force generated laterally or horizontally against the wall 30. Thus, the problem of "walking" is avoided.

A further feature in the operation of the present invention can be seen in FIG. 2 wherein it is shown that the distance from the ground to horizontal member 11 is greater on the right-hand side than on the left-hand side of the drawing. The bin would be inserted from the right-hand side since the opening is greater. Inserting and removing the bin is also enhanced by the rim 4 being sloped.

While the invention has been shown in one preferred embodiment or form, it will be obvious to those skilled in the art that this invention is not so limited but is susceptible of various changes and modifications without departing from the spirit thereof.

What is claimed is:

1. A trash compactor adapted for compacting trash received in a bin having an open top and slosed side walls and bottom, said compactor comprising:

a fixed support frame defining an area for removably receiving said bin with said bottom thereof positioned horizontally and with said frame horizontally in contact with one of said side walls of said bin;

compacting means, supported by said frame above said area, adapted for compacting trash received within said bin, said compacting means comprising:

a ram adapted for reciprocal motion, said ram having a single inclined surface for being driven into said bin, and actuating means for controllably driving said ram into said bin, whereby said single inclined surface compacts trash received within said bin and simultaneously imparts a single horizontal force to said bin through said trash such that said bin is held in place against said frame.

2. A trash compactor as in claim 1 further comprising means operatively associated with said bin for permitting placement and removal of said bin respectively into and out of said frame.

3. The trash compactor of claim 1 wherein said compacting means further includes a housing which encloses and supports said actuating means.

4. The trash compactor of claim 3 wherein said housing includes a door and chute through which trash may be placed to be received in said bin.

5. A trash compactor, comprising:

(a) a movable bin for receiving trash, said bin having a bottom, upright side walls, and an open top;

(b) a reinforced rim around the perimeter of said open top of said bin;

(c) a fixed support frame comprising a plurality of upright posts and a frame member supported by said posts and positioned so as to allow said bin to be placed thereunder;

(d) restraining bar integral with one side of said rectangular member, said restraining bar being positioned so as to contact said reinforced rim in such manner as to limit horizontal movement of said bin;

(e) a housing supported over said bin by said frame and having a generally open bottom;

(f) actuating means included within said housing;

(g) a ram operatively associated with said actuating means for controllable vertical movement thereby into and out of said bin;

(h) a single inclined surface associated with said ram for compacting trash within said bin during vertical reciprocation of said ram by said actuating means, said single inclined surface imparting during such vertical reciprocation a single horizontal force component through said trash against a bin side wall adjacent said restraining bar, thereby preventing horizontal movement of said bin as trash is compacted therein.

6. The trash compactor of claim 5 wherein said ram also has associated therewith a lower horizontal surface with said single inclined surface sloping upwardly away from said horizontal surface, whereby said horizontal surface, whereby said horizontal surface compacts said trash tightly while said single inclined surface compacts said trash and imparts said single horizontal force.

7. The trash compactor of claim 5 wherein the side of said rectangular frame member opposite said restraining bar is higher than said restraining bar side thereof, thereby increasing clearance in that side of said fixed support frame to allow said bin to be placed therein.

8. The trash compactor of claim 7 wherein one side wall of said bin is lower that an opposite side wall thereof, and such lower wall is placed on the leading side of said bin as it is placed into said frame, and said bin rim on said leading side wall is higher than said restraining bar.

9. The trash compactor of claim 5 wherein said housing includes a door facing said inclined surface of said ram so as to define a chute for placement of trash within said bin.

10. The trash compactor of claim 5, further including means on the exterior of said side walls of said bin for receiving forklift members to facilitate movement of said bin into and out of said support frame.

11. The trash compactor of claim 5, wherein said ram includes relatively high vertical side walls to prevent trash from gettting on top of said ram during vertical reciprocation thereof.

12. The trash compactor of claim 5 including ram guide means for maintaining vertical orientation of said ram during vertical reciprocation thereof.

* * * * *